United States Patent [19]

Virkus

[11] 4,254,410

[45] Mar. 3, 1981

[54] PSEUDO-RANDOM PULSE LINE SECURITY MONITORING SYSTEM

[75] Inventor: Mark K. Virkus, Overland, Mo.

[73] Assignee: Potter Electric Signal Co., St. Louis, Mo.

[21] Appl. No.: 14,909

[22] Filed: Feb. 26, 1979

[51] Int. Cl.[3] ..... G08B 29/00

[52] U.S. Cl. ..... 340/512; 340/164 R; 340/506; 340/531; 340/534; 340/538

[58] Field of Search ..... 340/512, 505, 506, 531, 340/533, 534, 164 R, 538, 167 R; 167 A

[56] References Cited

U.S. PATENT DOCUMENTS

| | | | |
|---|---|---|---|
| 3,293,605 | 12/1966 | Moore | 340/512 |
| 3,460,121 | 8/1969 | Wattenburg | 340/538 |
| 3,482,243 | 12/1969 | Buchsbaum | 340/538 |
| 3,641,547 | 2/1972 | Reiss et al. | 340/538 |
| 3,680,050 | 7/1972 | Griffin | 340/167 R |
| 3,735,353 | 5/1973 | Donovan et al. | 340/534 |
| 3,786,501 | 1/1974 | Marnerakis | 340/538 |
| 3,803,594 | 4/1974 | Klein et al. | 340/512 |
| 3,818,466 | 6/1974 | Honda | 340/538 |
| 3,886,534 | 5/1975 | Rosen et al. | 340/538 |
| 3,925,763 | 12/1975 | Wadhwani et al. | 340/538 |
| 4,005,399 | 1/1977 | Pazemenas | 340/538 |
| 4,023,163 | 5/1977 | Krishnaiyer et al. | 340/534 |

*Primary Examiner*—John W. Caldwell, Sr.
*Assistant Examiner*—Donnie L. Crosland
*Attorney, Agent, or Firm*—Jerome A. Gross

[57] ABSTRACT

Line security apparatus for a direct-wire alarm system utilizes a transmitter at the remote premises to impose on the direct current a small amplitude carrier frequency which is on/off modulated by a clocked, continuous progression of pseudo-random digital bits. A receiver, tuned for the carrier frequency, is utilized at the monitoring station to recover the progression of digital bits, if received at the monitoring station. A microprocessor at the monitoring station produces an identical and initially synchronous sequence of digital bits, compares the produced sequence to the progression of bits received, and effects a temporary alarm signal indicating that the line security is disrupted if the bits do not correspond. Because the lack of correspondence may be due to deviations of the transmitter and microprocessor clocks, the microprocessor seeks correspondence by shifting the produced sequence and, if successful, continues the comparison as shifted. If the shifting does not result in correspondence, an alarm is signalled.

7 Claims, 7 Drawing Figures

PSEUDO-RANDOM PULSE LINE SECURITY MONITORING SYSTEM

BACKGROUND OF THE INVENTION

The present invention relates to alarm systems and specifically to line security apparatus for alarm systems, particularly alarm systems of the direct current, direct wire type.

In a number of prior alarm systems, line security apparatus applies a square wave or sinusoidal security signal to one end of the communications line and detects whether the security signal is received at the opposite end. U.S. Pat. No. 3,786,501 to Marnerakis discloses a direct current alarm system having a sinusoidal security signal imposed on the direct current at the remote premises and apparatus at the monitoring station to detect the signal. In U.S. Pat. No. 3,641,547 to Reiss, et al., a detecting loop-type alarm system has line security apparatus which imposes at one end of the loop at the monitoring station a square wave which is periodically reduced in its positive amplitude. A detector at the monitoring station at the opposite end of the loop determines, during these periodic reductions, whether the security of the detecting loop has been breached by insertion of excessive resistance.

Circuitry for producing random patterns of digital bits is known to persons skilled in digital electronics.

SUMMARY OF THE INVENTION

The principal object of the present invention is to provide an improved line security monitoring system utilizing a security signal which varies in a seemingly random manner to one attempting to reproduce the signal and thereby breach without detection the line security. Another object is to provide such a line security system which lends itself to monitoring of a plurality of lines by a single digital processor.

These purposes and others are achieved in a direct-wire, direct-current alarm system by providing a transmitter at the remote premises to impose on the direct current small amplitude signals made up of a low frequency carrier on/off modulated by a continuous pseudo-random progression of digital bits. The pseudo-random bits are produced at a fixed rate by a circuit consisting of a clocked, parallel/serial shift register and an EXCLUSIVE OR gate. At the remote premises, a tuned filter circuit recovers the progression of digital bits by the presence of the carrier; thus, operation of the system is essentially not a function of the amplitude of the signal, which varies with the length of the communication line.

A microprocessor at the monitoring station produces an identical and initially synchronous sequence of digital bits and compares each bit as produced to the current bit recovered from the communication line. If the two bits do not correspond, a temporary alarm is effected and, after a 25-second delay, the sequence of bits is shifted, one bit at a time, to a maximum of two bits forward and two bits backward, seeking correspondence of the two bits. If, after shifting, correspondence is achieved for a significant number of successive bit comparisons, this indicates that the lack of correspondence was due to deviations in the respective rates of the transmitter and microprocessor clocks and no further alarm is effected, but if correspondence is not achieved, an alarm is signalled.

Where the digital bits are produced and transmitted at a relatively low rate, such as four per second, one microprocessor is capable of simultaneously monitoring the security of a large number of communication lines.

DESCRIPTION OF THE PREFERRED EMBODIMENT

Figure 1:
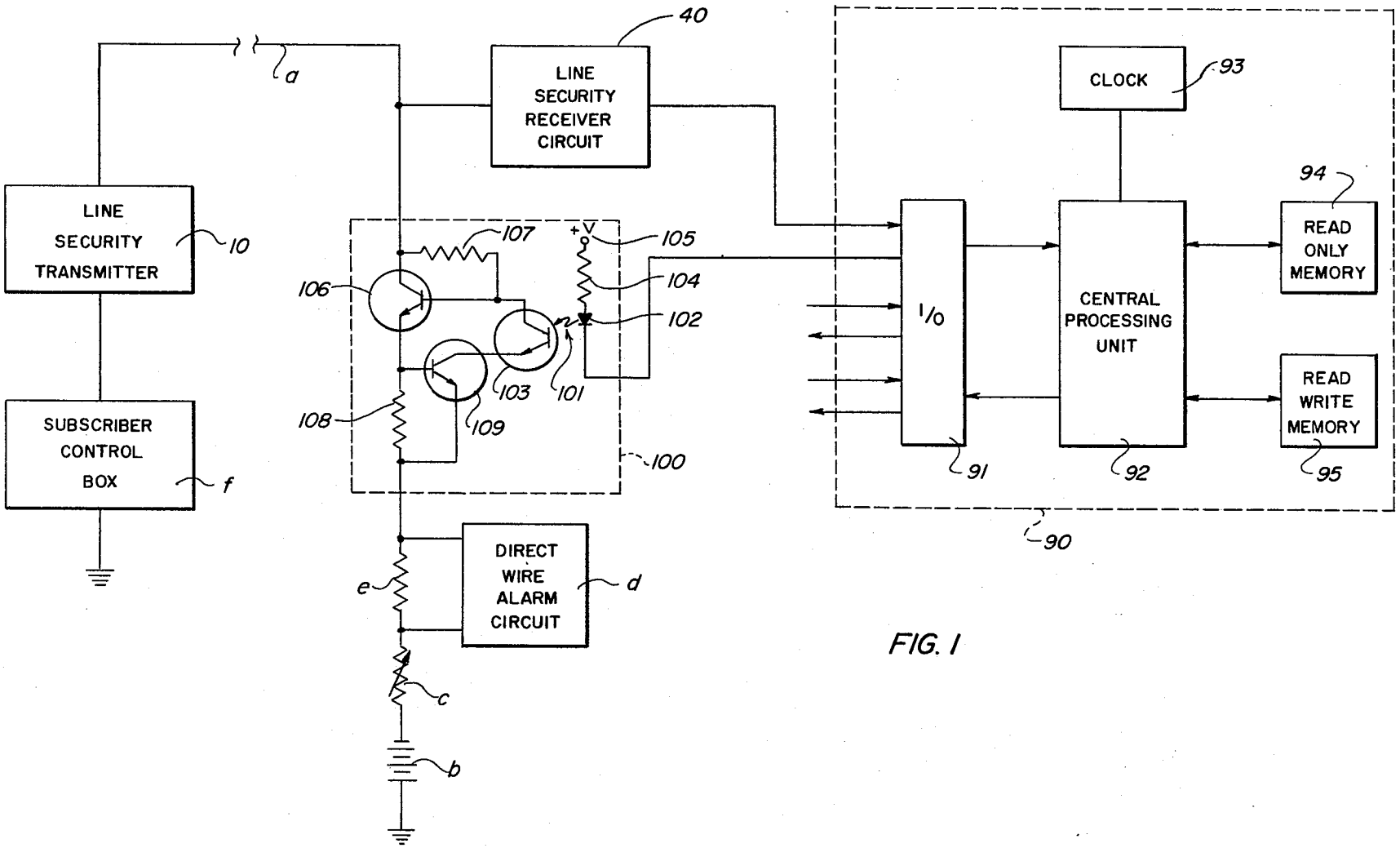
FIG. 1 is a wiring diagram, mostly in block diagram form, of a preferred embodiment of the line security apparatus of the present invention shown installed in a conventional direct wire alarm system.

The preferred embodiment of the present alarm system line security apparatus is utilized in a conventional alarm system, generally known as a central station direct wire, direct current type, shown mainly in block diagram form in FIG. 1. This conventional system utilizes a telephone line a, or other communication line, which extends from a subscriber's remote protected premises to a central monitoring station where a conventional 130-volt dc positive grounded power supply b supplies direct current to the telephone line a through a rheostat c. A direct wire alarm circuit d is coupled across a sampling resistor e in series with the telephone line a at the central station to sense changes in the current level in the line a. At the remote premises, a conventional subscriber's control box f is provided in series with the telephone line a to vary the current in the line a by switching and shunting resistors, indicating by different current levels various normal and alarm conditions.

In this conventional alarm system, novel line security apparatus is provided to monitor the security of the telephone line a. Described briefly, the apparatus includes a line security transmitter 10 at the remote premises in series with the telephone line a, to impose a pseudo-random security signal on the direct current in the line a at the remote premises. A line security receiver circuit 40 is coupled to the telephone line a at the central monitoring station to recover the security signal, if received. A microprocessor 90 at the central station receives the security signals from the receivers 40 for a number of alarm system telephone lines a. With the microprocessor utilized in this preferred embodiment, the Motorola Semiconductors 6802, line security for forty-eight subscribers may be monitored by the single microprocessor. This microprocessor 90 includes conventional elements, including an Input/Output integrated circuit 91 coupled to the central processing unit integrated circuit (CPU) 92. The rate of operation of the CPU 92 is regulated by a fixed frequency clock 93, which may be subject to limited rate deviations, generally not greater than 2%. A read-only-memory (ROM) 94 supplies program instructions for operation of the CPU 92 and a random-access-memory (RAM) 95 stores information during operation.

In order to indicate that the line security has been disrupted, a current limiter circuit 100 is utilized, in series in the telephone line a, to limit the current to a reduced value as an indication that the security of the line has been reached. This reduced level of current is detected by the direct wire alarm circuit d which then indicates to a central station operator that the breach has occurred. The current limiter circuit utilizes an optical isolator, generally designated 101, having a light emitting diode (LED) 102 optically coupled to a phototransistor 103. The cathode of the LED 102 is coupled to an output of the microprocessor 90, while its anode is coupled through a pull-up resistor 104 to a dc voltage 105. The collector-emitter terminals of a power transistor 106 are coupled in series in the telephone line a; the base of power transistor 106 is biased by a biasing resistor 107 coupled to its collector and is coupled to the collector of the phototransistor 103. A 270 ohm resistor 108 is coupled in the telephone line between the emitter of the power transistor 106 and the sampling resistor e.

The emitter of the phototransistor 103 is connected to the collector of a second transistor 109, whose base is connected to the emitter of the power transistor 106 and whose emitter is connected to the telephone line between the 270 ohm resistor 108 and sampling resistor e.

Line Security Transmitter

Figure 2:
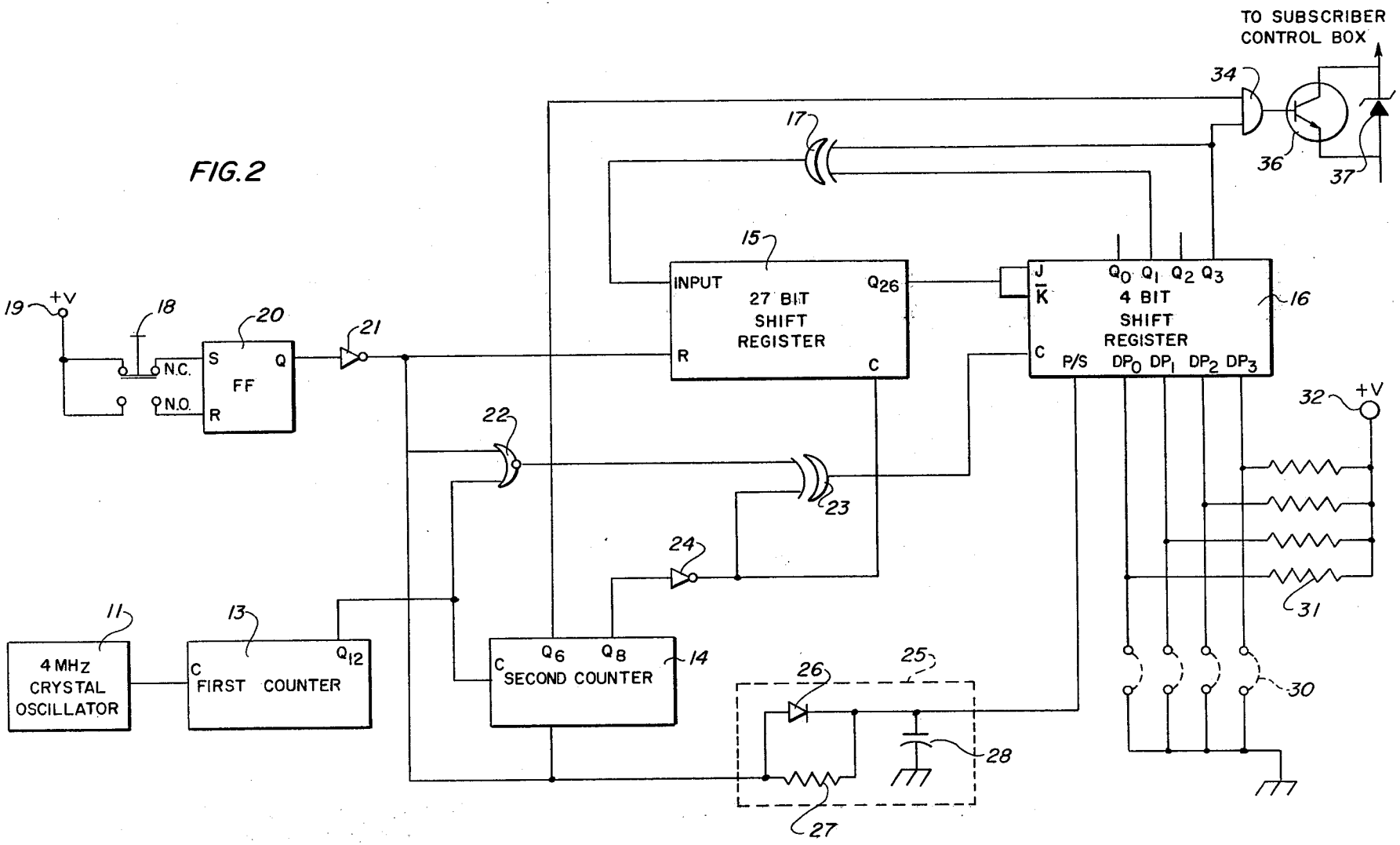
FIG. 2 is a wiring diagram of the line security transmitter of the preferred embodiment.

The line security or code transmitter 10, shown in detail in FIG. 2, is utilized to produce and impose on the direct current in the telephone line a, a square wave which is on/off modulated by a continuous progression of pseudo-random digital bits. The transmitter 10 utilizes a conventional 4 MHz crystal oscillator or clock 11 which may include circuitry to square up the oscillating signal to a substantially perfect square wave. The oscillator 11 drives the clock input of a first 12-bit binary counter 13, utilized as a divide-down circuit to divide the incoming square wave by $2^{12}$ (4,096). In the preferred embodiment, the counter utilized in an integrated circuit, the MC14040B manufactured by Motorola Semiconductors. The $Q_{12}$ output of the first counter 13 is coupled to the clock input of a second 12-bit binary counter 14, identical to the first.

In order to produce the progression of pseudo-random digital bits, the transmitter 10 utilizes a variable length serial shift register 15, a 4-bit parallel/serial shift register 16 and an EXCLUSIVE OR (XOR) gate 17, which together function as a code generator. In the preferred embodiment, the variable length shift register 15 is the MC14557B manufactured by Motorola Semiconductors and its length is set as twenty-seven bits, its output being indicated by $Q_{26}$. This output is coupled to the input of the 4-bit shift register 16, which in the preferred embodiment is the Motorola Semiconductors MC14035B integrated circuit. In use of this integrated circuit, the J and $\overline{K}$ inputs are coupled together to form the input to the register. The register 16 has four parallel inputs, marked $DP_0$–$DP_3$ and four parallel outputs marked $Q_0$–$Q_3$. The $Q_1$ and $Q_3$ parallel outputs are coupled to the two inputs of the XOR gate 17, whose output is coupled to the input of the variable shift register 15, hereafter called the 27-bit shift register.

For use on start-up of the transmitter 10, a normally closed push-button reset switch 18 having one each of its normally open and normally closed terminals coupled to a digital voltage supply 19 is provided. The other normally closed terminal is connected to the set input of a set-reset flip-flop 20, while the other normally open terminal is connected to the reset input of the flip-flop 20. An inverter 21 on the Q output of the flip-flop 20 couples it to the reset inputs of both the 27-bit shift register 15 and the second counter 14. A two-input NOR gate 22 has one input coupled to the output of the flip-flop 20 by the inverter 21, its other input to the $Q_{12}$ output of the first counter 13, and its output to one input of a second XOR gate 23. The other input of the second XOR gate 23 is coupled from the $Q_8$ output (divide by $2^8$ or 256) of the second counter 14 by an inverter 24, and its output is coupled to the clock input of the 4-bit shift register 16. The clock input of the 27-bit shift register 15 is also coupled to the $Q_8$ output of the second counter 14 by this second inverter 24.

The output of the first inverter 21 is coupled through a time delay circuit 25 to the parallel/serial (P/S) input of the 4-bit shift register 16. The time delay circuit 25 comprises the parallel combination of a diode 26 and resistor 27, with the anode of the diode 26 to the output of the inverter 21 and its cathode to the P/S input of the shift register 16. A capacitor 28 is coupled from the cathode of the diode 26 to chassis ground.

Four jumper terminals 30 are provided to permit coupling the four parallel inputs of the 4-bit shift register 16, $DP_0$–$DP_3$, to chassis ground. Each parallel input also is coupled to a digital voltage source 32 by a pull-up resistor 31.

The $Q_3$ output of the 4-bit shift register 16, which also forms the serial output of the shift register 16, is coupled to one input of a two-input AND gate 34. The other input of the AND gate 34 is coupled to the $Q_6$ (divide by $2^6$ or 64) output of the second counter 14. The output of the AND gate 34 drives the base of a power transistor 36, which is coupled by its collector to the cathode and by its emitter to the anode of a zener diode 37. The zener diode 37, which has a 20-volt breakdown, is in series in the telephone line at the remote premises, with its cathode connected to the subscriber's control box f.

Line Security Receiver

Figure 3:
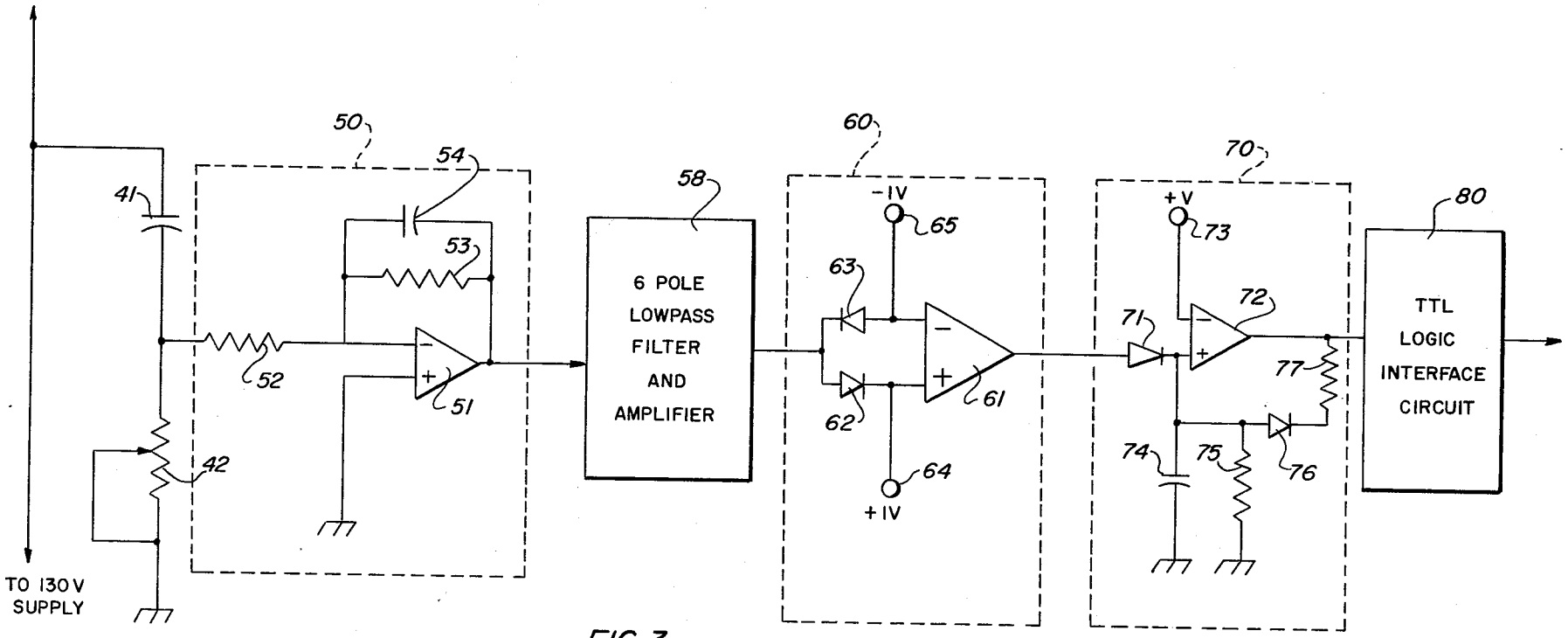
FIG. 3 is a wiring diagram, partially in block diagram form, of the line security receiver of the preferred embodiment.

The line security or code receiver 40, shown in FIG. 3, is provided at the central station to recover the security signal imposed on the direct current in the communications line a by the line security transmitter 10. The receiver 40 connects to the telephone line a at the central station by a coupling capacitor 41 which is in series with a potentiometer 42 connected to chassis ground.

A two-pole lowpass active filter network 50, having a cut-off frequency of 20 Hz, is coupled to the common terminals of the coupling capacitor 41 and potentiometer 42. The two-pole filter network 50 is comprised of an operational amplifier 51 having its inverting input coupled to the connected terminals of the capacitor 41 and potentiometer 42 by an input resistor 52. Its non-inverting input is coupled to chassis ground. The parallel combination of a feedback resistor 53 and feedback capacitor 54 form a feedback loop from the output of the operational amplifier 51 to its inverting input.

The output of the operational amplifier 51, forming the output of the two-pole filter network 50, is coupled to a conventional six-pole lowpass filter and amplifier network 58, shown simply as a block in FIG. 3. The network 58 has a 20 Hz cut-off frequency and a gain on the order of 10–20.

The output of the six-pole filter and amplifier network 58 is coupled to a full-wave rectifier circuit 60, of the type sometimes known as an absolute value amplifier. It utilizes an operational amplifier 61 having both of its inputs coupled to the output of the six-pole filter 58, the non-inverting input by a diode 62 having its cathode to the non-inverting input, and the inverting input by a second diode 63 having its anode to the inverting input. The non-inverting input is connected to a +1 volt dc supply 64 and the inverting input is connected to a −1 volt dc supply 65.

A timed retriggerable one-shot circuit 70 is coupled to the output of the rectifier operational amplifier 61 by a coupling diode 71, whose anode is connected to the non-inverting input of an operational amplifier 72 having its inverting input connected to a +1.4 volt dc supply 73. The parallel combination of a timing capacitor 74 and timing resistor 75 connects the non-inverting input of the op amp 72 to chassis ground. The series combination of a discharge diode 76 and discharge resistor 77 couples the non-inverting input to the output of the op amp 72.

The one-shot circuit 70 drives a conventional TTL logic interface circuit 80, shown as a block in FIG. 3.

Operation of the Apparatus

Briefly, the line security apparatus functions in the following manner: the transmitter 10 at the remote premises imposes a pseudo-random progression of digital bits on the direct current which progress at a rate of 3.8 Hz and are modulated by square pulses at four times that rate, or 15.2 Hz. Though the term "pseudo-random" is conventionally used, the progression is not random; in this embodiment it repeats approximately every 18 years. The progression seems to be random, but is reproduceable, as a selected code. At the central station, the line security receiver 40 recovers these digital bits, if received at the central station, by sensing the 15.2 Hz carrier frequency. The microprocessor 90 produces an identical sequence of pseudo-random bits, which initially are synchronous with those produced at the remote premises, and the produced sequence is compared to the recovered progression of digital bits. If the incoming bit does not correspond to the produced bits, an alarm is effected by the current limiter 100 by reducing the current level in the telephone line a to such a level that the direct wire alarm circuit d signals an alarm (in this embodiment, 5 ma). Then, the microprocessor 90 effects limited shifting of the produced sequence of digital bits to seek correspondence of the two bits, which may be achieved where the lack of correspondence is due to deviation of the clocks.

The current limiter 100 operates in the following manner: when an alarm is not being generated, the output of the microprocessor I/O interface 91 to the current limiter is high, the LED 102 does not conduct, and the phototransistor 103 is off. The power transistor 106 is biased on by the biasing resistor 107; the current splits between the 270 ohm resistor 108 and the base-emitter junction of the second transistor 109. When an alarm is to be generated, the output of the interface 91 goes low and the LED 102 conducts, turning on the phototransistor 103. Since the second transistor 109 is conducting, it draws current from the base of the power transistor 106, reducing its conductivity. As the current in the line a is reduced, the second transistor becomes less conducting; the quiescent level for the line current is about 5 ma.

OPERATION OF LINE SECURITY TRANSMITTER

In operation of the line security transmitter 10, shown in FIG. 2, the crystal oscillator 11 produces a square wave of 4 MHz. The first counter 13 receives this square wave at its clock input and divides it down by 4,096 to produce a square wave at its $Q_{12}$ output of approximately 980 Hz. The second counter 14 utilizes this 980 Hz square wave at its clock input to produce a square wave at its $Q_6$ (divide by $2^6$ or 64) output of approximately 15.2 Hz and a square wave at its $Q^8$ (divide by $2^8$ or 256) output of approximately 3.8 Hz.

The output of the flip-flop 20 is normally high, but when the push-button switch 18 is pressed to connect its normally-open terminals, the output of the flip-flop 20 goes low. The output of the inverter 21, normally low, goes high when the switch is pressed, causing the 27-bit shift register 15 and the second counter 14 to reset and enabling the NOR gate 22. The 980 Hz signal from the first counter 13 passes through the NOR gate 22 to the XOR gate 23 while the reset button is pressed.

The 27-bit shift register 15 operates at a clock rate frequency of 3.8 Hz. Likewise, the 4-bit shift register 16 also operates at that rate, but its clock input is received from the XOR gate 23 having the alternate inputs from the NOR gate 22 (980 Hz) and the inverter 24 coupled to the $Q^8$ output of the second counter 14 (3.8 Hz). When the reset button 18 is pressed, because the 980 Hz pulse is received before the 3.8 Hz pulse, the clock input of the 4-bit shift register 16 receives its pulse slightly before the clock input of the 27-bit shift register 15.

The jumper terminals 30 are utilized to pull the parallel inputs of the 4-bit shift register 16 to a low digital state to initialize the register on start-up, selecting the desired progression of bits, like a reproduceable code. The parallel inputs are otherwise held high by the pull-up resistors 31 tied to the digital power source 32. When setting the jumper terminals 30 for start-up, to effect a progression of pseudo-random bits at least one jumper 30 must not be connected, to allow its associated parallel input to be pulled high.

The time delay circuit 25 ties the inverter 21 from the flip-flop 20 to the P/S input of the 4-bit shift register 16, functioning to hold the P/S input of the register 16 high for a short time after the reset button 18 is released. The register 16 operates in the parallel mode when its P/S input is high. The time delay assures that the inputs loaded into the shift register 16 via the jumper terminals 30 are held long enough for the XOR gate 17, connected to two of its parallel outputs $Q_1$ and $Q_3$, to input the new bit to the 27-bit shift register 15 before the first shift occurs. The time delay circuit 25 is of the type which delays only on a decrease from high to low, due to the presence of the diode 26.

The AND gate 34 serves essentially as a mixer for on/off modulation of the 15.2 Hz carrier or modulating frequency received from the $Q_6$ output of the second counter 14 with the continuous progression of pseudo-random digital bits received from the $Q_3$ output of the 4-bit shift register 16. This modulated digital signal is imposed on the telephone line a by the combination of the power transistor 36, utilized as a switch, and the 20-volt zener diode 37. The diode 37 has a voltage drop of 20 volts when the transistor 36 is off, slightly reducing the current level in the line. When the transistor 36 is on, the diode 37 is shunted and no voltage drop is imposed. The change in amplitude of the current caused by the 20-volt zener diode 37 is not enough to cause an alarm on the direct wire alarm circuit d, but the carrier is sensed by the line security receiver 40.

On start-up of the system, the reset swich 18 is pressed and the jumper terminals 30 are connected as desired. This connection information is telephoned to the central station and inputted to the microprocessor 90. Then the switch 18 is released and the coded progression of digital signals is transmitted; line security monitoring by the microprocessor 90 for the subscriber begins upon its reception of the first one-bit.

Operation of Line Security Receiver

At the monitoring station, the modulated digital signals are recovered by the receiver 40, if present on the telephone line a at the central station. The coupling capacitor 41 at the input of the receiver 40 is of such capacitance as to block the dc current component and recover the modulated digital signals. The potentiometer 42 matches the impedance of the receiver to that of the telephone line a, to maximize the reception of the receiver 40. The two-pole filter network 50 lowpass filters the incoming signal to remove frequencies greater than its 20 Hz cut-off; it operates not unlike any other conventional active lowpass filter utilizing an op amp with capacitive feedback. The six-pole lowpass filter and amplifier 58 further filters out frequencies greater than 20 Hz and amplifies the filtered signal. The filters 50, 58 remove all but the 15.2 Hz sinusoidal component of the square wave, on/off modulated by the progression of pseudo-random digital bits.

The rectifier or absolute value amplifier 60 provides full-wave rectification of the sinusoid, with a limitation that no output is produced unless the voltage exceeds either in the positive direction +1 volt or in the negative direction −1 volt. Thus, any low amplitude noise is filtered out.

The timed retriggerable one-shot circuit 70 functions to fashion the rectified sinusoid into the original progression of digital bits created by the transmitter 10 at the protected premises and functioning like a peak detector circuit. The operational amplifier 72 has power so supplied to it as to cause it to saturate at +5 volts or −5 volts; when the non-inverting input of the op amp 72 goes above +1.4 volts, the voltage supplied at its inverting input, its output saturates at +5 volts, otherwise its output is −5 volts. The combination of the timing capacitor and resistor 74, 75, which has an RC time constant of approximately 27 milliseconds, has little significance for rising voltages; the capacitor 74 charges through the coupling diode 71 very quickly. However, when the voltage at the non-inverting input of the op amp 72 falls, the capacitor 74 discharges slowly through the resistor 75 until the non-inverting input drops below 1.4 volts; then the op amp 72 saturates at −5 volts and the capacitor 74 discharges quickly through the diode 76 and low value resistor 77 into the interface circuit 80. The RC time constant of the timing capacitor and resistor 74, 75 is sufficient to bridge the time gap between the 1.4 volt levels of the two adjacent rectified sinusoids of the 15.2 Hz carrier. The output of the one-shot 70 is always high when it receives the 15.2 Hz carrier and low when it does not.

Since the microprocessor 90 utilizes 0–5 volt logic, the conventional logic interface circuit 80 is utilized to convert the −5 to +5 volt output of the one-shot 80 to 0–5 volt logic.

Operation of the Microprocessor

Briefly described, the microprocessor produces a sequence of digital bits which are identical to the progression of digital bits produced by the line security transmitter 10. The sequence produced by the microprocessor 90 is initially made synchronous with the progression imposed on the telephone line a by the transmitter 10, but due to deviations of the clock of the transmitter 10 and microprocessor 90, the corresponding bits may lose synchronism. If this deviation occurs, so that comparison of the incoming bits to the produced bit shows a lack of correspondence, the microprocessor signals a temporary alarm, puts the subscriber in a delay status for 25 seconds, and after the delay compares the bits again. If they do not correspond, the processor puts the subscriber in a shift status in which the produced sequence is shifted one bit at a time, to a maximum of two bits forward and two bits backward, seeking to achieve synchronism once again. If this synchronism is achieved and 32 successive correct bits are received, the comparison continues with the shifted sequence. If this new correspondence is not achieved after the four shifts, a permanent alarm is signaled.

The microprocessor ROM 94 contains machine language instructions for the microprocessor for the operations required, as indicated in the flow diagram shown in FIGS. 4, 5, 6 and 7. These operational steps are all interrelated, but four separate drawings are used for their illustration, for purposes of clarity. The RAM 95 is utilized for storage of both the bits recovered from the telephone line a by the receiver 40 and for the sequence of bits produced by the microprocessor 90. Certain registers in the RAM 95 are used for counting the number of successive correct bits after an incorrect bit occurs; this is later referred to as a restore counter.

Figure 7:
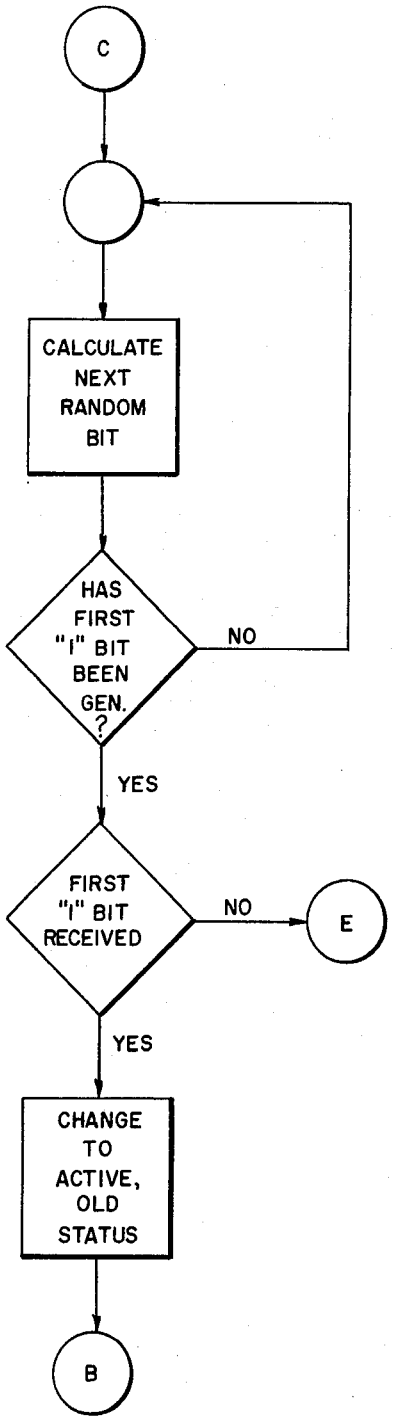

Describing specifically the operations performed by the microprocessor 90: initialization of the microprocessor (FIG. 4) includes such steps as clearing the RAM 95 and is only performed when the microprocessor 90 is first turned on and the first subscriber is brought on. Once initialization is complete, the system interrupts are disabled, so that in the following step, the microprocessor can read the current time and the current input bits from the forty-eight line security receivers 40 for the telephone lines a monitored. These inputs are stored in the RAM 95 and the interrupts are then enabled so that it is possible for the microprocessor to accept input information, manually entered from a keyboard terminal, such as the initialization information for new subscribers added. Next, the processor 90 checks the status of the first subscriber, or if other subscribers have already been checked, it checks the status of the next subscriber, as stored in the RAM 95. Subscribers which are not yet active are skipped. After the last subscriber, the interrupts are disabled and the current time and inputs are again read.

Where the next subscriber to be compared is active, the microprocessor asks whether this is a new subscriber (A, FIG. 5); if the subscriber is new, the microprocessor 90 prepares to and begins to generate the pseudo-random digital bits, in a sequence identical to the progression produced and imposed at the remote premises only until the first one-bit occurs (C, FIG. 7). Then, the microprocessor 90 determines or senses whether the first one-bit has been received and recovered by the line security receiver 40. If not, the processor 90 returns to check the next subscriber's status (E, FIG. 4). If the first one-bit produced by the transmitter 10 has been received, the new subscriber is updated to active, old status, the next time for which the incoming bit is to be checked and the next bit for this subscriber is calculated and stored in the RAM 95 (B, FIG. 4), and the microprocessor then checks the next subscriber.

Now that the new subscriber has active old status, generation of the sequence of pseudo-random digital bits will continue synchronously with the production of the coded progression imposed at the remote premises.

The generation of the random bits by the microprocessor is performed by a machine language algorithm similar to the principle utilized by the shift register hardware, shown in FIG. 2. The RAM 95 has a 32-bit memory register for each subscriber to store the bit sequence produced which is initially set by input information identifying initialization of the code generator at the remote premises. The 28th and 31st bits are added and the right-most digit of their binary sum is fed into the first bit of the 32-bit register as the register is shifted one bit. The 32nd bit in the register is the bit which is compared with the incoming bit.

Figure 4:
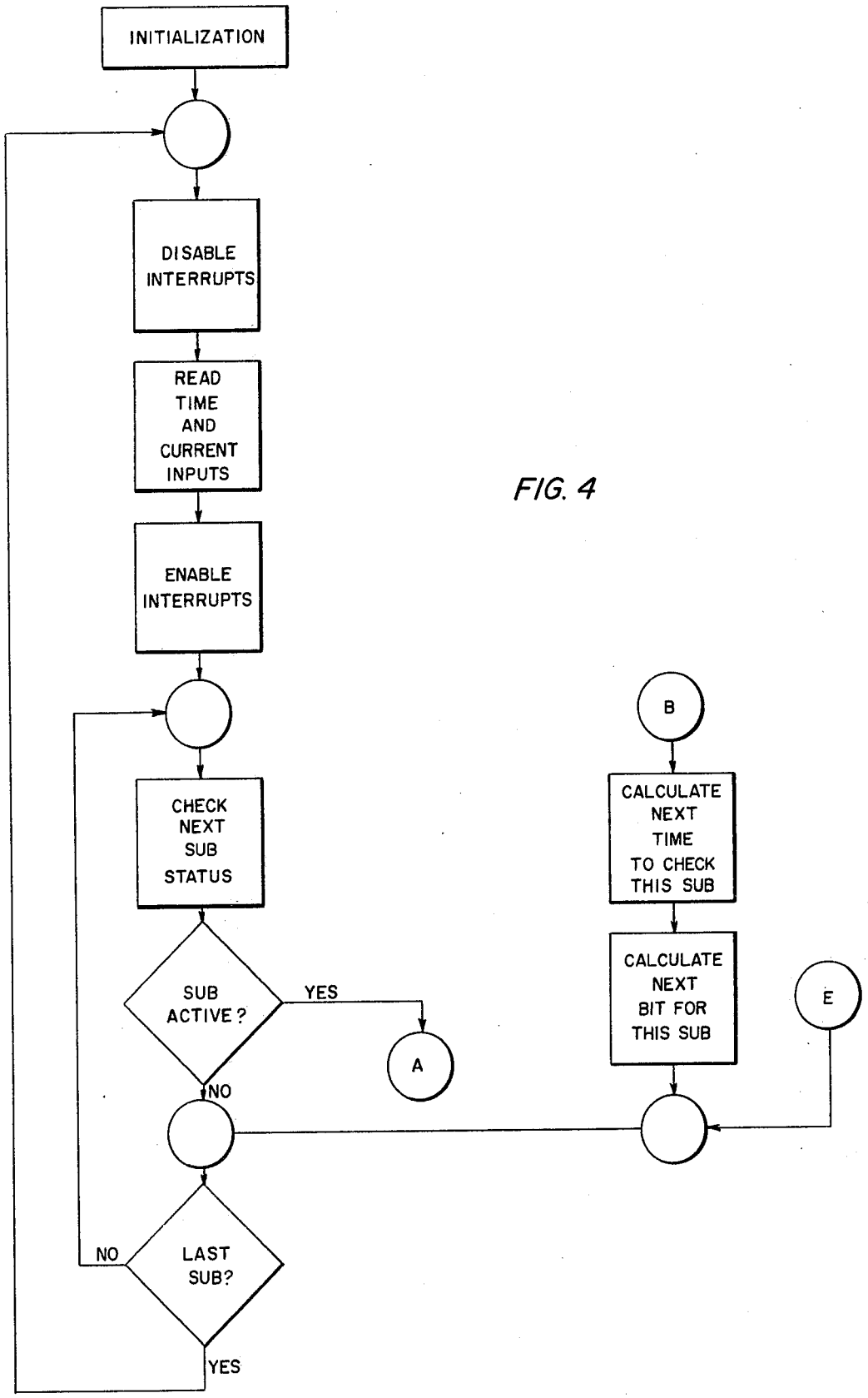
FIGS. 4, 5, 6 and 7 together show a flow chart of the operations performed by the microprocessor in detecting whether the line security has been compromised. The four figures are cross-referenced by upper-case letters.
Figure 5:
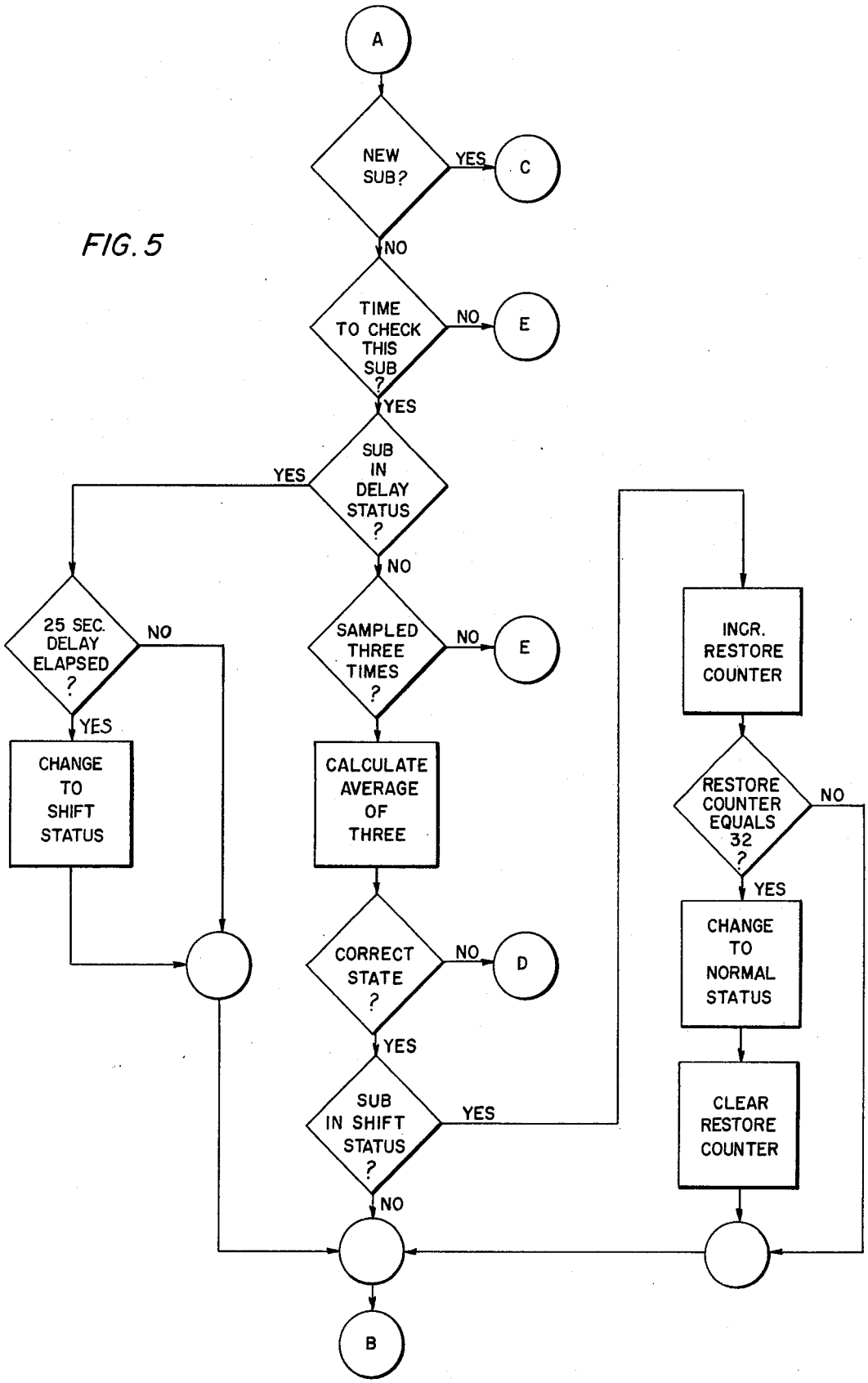

If, upon checking, the subscriber is not new (A, FIG. 5), the microprocessor 90 then determines whether it is time to check this subscriber. If not, it again returns to take up the next subscriber (E, FIG. 4). When it is time to check the subscriber, the processor first determines whether the subscriber has 25-second delay status, which the subscriber is given when a breach in the line security is indicated by the noncorrespondence of the incoming bit to the produced bit. This delay makes possible time for a subscriber to leave the premises causing a temporary, but not permanent, alarm.

Where it is determined that it is time to check the subscriber, but he has 25-second delay status, the microprocessor 90 determines whether this 25-second delay has elapsed and, if so, the subscriber is updated to shift status, the information for the subscriber for the next incoming bit is calculated, and the next subscriber is taken up (B, FIG. 4).

Assuming the subscriber does not have 25-second delay status, the microprocessor determines whether the particular subscriber has been sampled three times for this particular bit comparison. For purposes of noise elimination, the microprocessor samples each incoming bit three times; the average of the three is taken as the state of the digital bit. If the processor 90 has not sampled three times, it returns to take up the next subscriber (E, FIG. 4), and after the last subscriber, to again read the inputs. Therefore, the processor 90 reads each of the forty-eight inputs three times during the period corresponding to the frequency of 3.8 Hz, which is approximately 260 milliseconds. If the processor 90 has sampled this subscriber three times, then the average of the three is calculated and the actual comparison to determine whether the bit is in the correct state is made.

Figure 6:
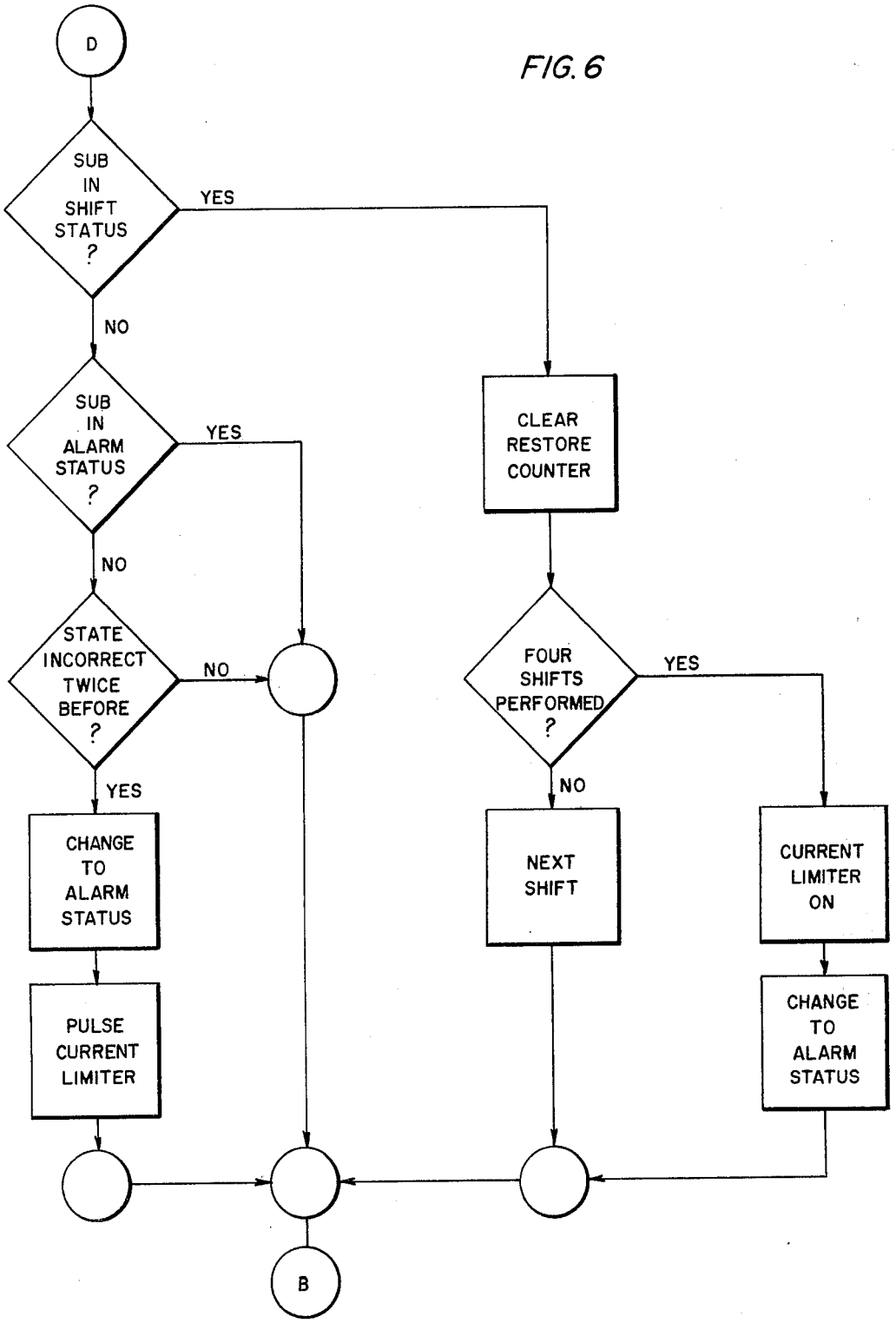

If the average of the sampled bits is not the same as the produced bit, the processor 90 checks whether the subscriber has 25-second delay status (D, FIG. 6). If not, the processor 90 checks whether the subscriber has either shift or alarm status at present. If neither, the microprocessor 90 then determines whether the state has been incorrect two times before, each including three samples; the processor does not consider that a line security breach exists until three incorrect bits are received without 32 consecutive correct bits between any two incorrect bits, to eliminate noise. Where the three incorrect bits have occurred, the microprocessor 90 updates this subscriber to a delay status and pulses the current limiter on for one bit-time, causing the direct wire alarm circuit d to indicate a temporary alarm condition.

If, in the alternative, a subscriber has alarm status, the microprocessor 90 calculates the information for this subscriber for the next incoming bit and goes to the next subscriber (B, FIG. 4). Where the state of the bit is incorrect and the subscriber already has shift status (B, FIG. 6), the microprocessor determines whether all four available shifts have been performed, if not, the next shift operation is performed. The first shift operation is one bit backwards; the second is one additional bit backwards. If both backward shifts have been performed, the next shift operation is three bits forward, and the fourth and final is a forward shift of one bit. Where all four shifts have been performed without success in seeking correspondence, the current limiter is turned on constantly to indicate an alarm condition and the status of the subscriber is updated to alarm, after which the information for this subscriber for the next incoming bit is calculated and stored and the next subscriber is taken up. When the subscriber is in this permanent alarm condition, a return to normal is possible if 32 consecutive current bits are received.

When, in checking whether the correct state has been received (FIG. 5), the two bits are the same, the processor 90 next determines whether the subscriber has either shift or alarm status. If so, the restore counter is incremented, indicating the number of successive correct bits since the incorrect bit was received. When the restore counter equals thirty-two, the subscriber is returned to normal status and the restore counter is cleared. In either case, the next time to check the subscriber and the next bit is calculated and stored and the processor returns to take up the next subscriber (B, FIG. 4).

ADVANTAGES AND MODIFICATIONS

The novel line security apparatus described above is of principal advantage in that it utilizes as a security signal a progression of digital bits which are seemingly random so as not to be predicted by one who wishes to compromise the system. Use of the digital signals permits use of a microprocessor to monitor the security of a large number of lines. By using a modulated signal, the digital bits are recovered at the central station by the presence of the carrier frequency, not as a function of the amplitude of the security signal; this permits utilizing relatively low amplitudes for the signal.

The digital processor affords a unique and novel medium for manipulating the recovered digital bits and determining whether the line has been compromised or its security otherwise disturbed, taking into account probable relative deviations in the clocks for the transmitter and microprocessor.

The apparatus described is a preferred embodiment of the invention; various modifications may be made without departing from its basic concept. In the transmitter, other means to produce the selected coded programs of digital bits may be utilized, as well as to impose them on the communications line. Though the on/off modulation described is quite advantageous for the digital signals, other forms of amplitude or frequency modulation may be utilized. Any receiver capable of recovering from signals received at the monitoring station such coded progression of digital bit as may be present, is appropriate. Many types of conventional filter circuits may be utilized to recover the modulated signals, as well as to remove the modulating or carrier frequency. The operations performed by the microprocessor may be modified in many ways to determine whether that security signal transmitted has been received.

Other modifications will, from the above examples, be apparent to persons skilled in the art.

I claim:

1. For use with an alarm system of the type utilizing a direct current communications line from remote premises to a monitoring station, line security apparatus to monitor the security of the communications line, comprising a code transmitter at the remote premises including code generator means to produce a selected coded progression of digital bits at a clock rate frequency, means to provide a carrier frequency greater than the clock rate frequency, means to modulate the carrier frequency according to the coded progression of digital bits, whereby to produce digital signals, means to impose such digital signals on the direct current in the communications line at the remote premises, and further comprising a receiver at the monitoring station including first filter means, operably coupled to the communications line, to recover and produce at its output signals modulated at the carrier frequency, second filter means, operably connected to the output of said first filter means, to remove the carrier frequency, whereby to recover the coded progression of digital bits, digital processor means operably coupled to said second filter means, to determine whether the selected coded progression of digital bits produced at the remote premises is identical to that recovered at the monitoring station by said second filter means, thereby to indicate whether the security of the communications line has been disturbed, and current limiter means, in the communications line, operatively coupled to said processing means to limit the direct current to a reduced level on occurrence of an indication by said processing means that the coded progression is not identically received.

2. The line security apparatus as defined in claim 1 in which the system is further of the type for which an alarm condition corresponds to a reduced level of direct current, further comprising current limiter means, in the communications line, operatively coupled to said processing means to limit the direct current to said reduced level on occurrence of an indication by said processing means that the coded progression is not identically received.

3. The line security apparatus as defined in claim 1 wherein said means to impose digital signals on the direct current includes a zener diode in series in the communications line, and switch means, coupled to said means to modulate the carrier frequency, to alternately shunt the zener diode according to the coded progression of digital bits.

4. An alarm system of the type utilizing a communications line from remote premises to a monitoring station, comprising (a) a code transmitter at the remote premises, including clock means to produce clock pulses at a clock rate frequency, code generator means to produce a selected coded progression of digital bits at the clock rate frequency, means to impose digital signals corresponding to the selected coded progression of digital bits on the communications line at the remote premises, together with (b) a code receiver coupled to the communications line at the monitoring station and including filter means to recover, from signals received at the monitoring station, such coded progression of digital bits as may be present in and correspond to such signals, and digital processor means, including a central clock, to (1) produce, at a rate controlled by the central clock, a sequence of digital bits identical to the coded progression so imposed at the remote premises and substantially synchronously therewith.

(2) compare the produced sequence of digital bits to such coded progression of digital bits as is recovered by said filter means, and thereby determine if such produced sequence and such code progression are out of correspondence, (3) effect a shift in the produced sequence when out of correspondence with the coded progression, compare the shifted sequence with the coded progression, and, should correspondence be achieved by the shifting, continue the comparison as so shifted; and (4) effect an alarm condition if such shifting does not achieve correspondence.

5. For use with an alarm system of the type utilizing a direct current communications line from remote premises to a monitoring station, line security apparatus to monitor the security of the communications line, comprising (a) a code transmitter at the remote premises, including a code generator including a clock, whereby to produce a selected coded progression of digital bits at a clock rate frequency, said code generator further including means to initialize said code generator with a selected pattern of digital bits, and switch means to start up operation of said code generator said code transmitter further including means to impose digital signals corresponding to the selected coded progression of digital bits on the direct current in the communications line, together with (b) a code receiver coupled to the communications line at the monitoring station and including filter means to recover, from signals received at the monitoring station, such coded progression of digital bits and digital processor means, including a central clock, to (1) accept as input information such selected pattern of digital bits and therefrom prepare to generate a sequence of digital bits identical to the coded progression imposed at the remote premises, (2) generate the sequence only until the first digital bit of a selected binary state is produced, (3) sense, upon start-up of said code generator by said switch means at the remote premises, the reception at the monitoring station of the first digital bit of said selected binary state in the coded progression of digital bits as recovered by said filter means, and thereupon (4) recommence and continue generation of the sequence synchronously with the coded progression so produced at the remote premises.

6. For use with an alarm system of the type utilizing a direct current communications line from remote premises to a monitoring station, line security apparatus to monitor the security of the communications line, comprising (a) a code transmitter at the remote premises including clock means to produce clock pulses at a clock rate frequency, code generator means to produce a selected coded progression of digital bits at the clock rate frequency, means to impose digital signals corresponding to the selected coded progression of digital bits on the direct current in the communications line, together with (b) a code receiver coupled to the communications line at the monitoring station and including filter means to recover from signals received at the monitoring station, such coded progression of digital bits, (c) digital processor means, including a clock, to determine whether the selected coded progression of digital bits produced at the remote premises is identical to that recovered at the monitoring station by said filter means, thereby to indicate whether the security of the communications line has been disturbed, and current limiter means, in the communications line, operatively coupled to said processing means to limit the direct current to a reduced level on occurrence of an indication by said processing means that the coded progression is not identically received.

7. The line security apparatus as defined in claim 6, wherein said means to impose digital signals on the direct current includes a zener diode in series in the communications line, and switch means to alternately shunt the zener diode according to the coded progression of digital bits produced by said code generator means.

* * * * *

UNITED STATES PATENT AND TRADEMARK OFFICE

CERTIFICATE OF CORRECTION

PATENT NO. : 4,254,410

DATED : March 3, 1981

INVENTOR(S) : Mark K. Virkus

It is certified that error appears in the above—identified patent and that said Letters Patent is hereby corrected as shown below:

Column 3, line 5 "reached" should be ---breached---;

Column 3, line 61 add ---length--- after "variable"; and

Signed and Sealed this

Thirtieth Day of June 1981

[SEAL]

Attest:

RENE D. TEGTMEYER

Attesting Officer

Acting Commissioner of Patents and Trademarks